US006523830B1

(12) United States Patent
Yuan

(10) Patent No.: US 6,523,830 B1
(45) Date of Patent: Feb. 25, 2003

(54) CASINO GAME

(76) Inventor: Tsuan Yuan, 4628 Nolan La., Las Vegas, NV (US) 89107

( * ) Notice: Subject to any disclaimer, the term of this patent is extended or adjusted under 35 U.S.C. 154(b) by 0 days.

(21) Appl. No.: 09/702,170

(22) Filed: Oct. 30, 2000

Related U.S. Application Data

(60) Provisional application No. 60/202,037, filed on May 5, 2000.

(51) Int. Cl.[7] ..... A63F 1/00

(52) U.S. Cl. ..... 273/292; 273/303; 273/274

(58) Field of Search ..... 273/303, 292, 273/274

(56) References Cited

U.S. PATENT DOCUMENTS 4,813,675 A * 3/1989 Greenwood ..... 273/138 A
5,098,107 A * 3/1992 Boylan et al. ..... 273/292
5,257,784 A * 11/1993 Boylan et al. ..... 273/138 R
5,265,877 A * 11/1993 Boylan et al. ..... 273/139
5,364,105 A * 11/1994 Jones ..... 273/292
5,377,973 A * 1/1995 Jones et al. ..... 273/85 CP
5,382,025 A * 1/1995 Sklansky et al. ..... 273/292
5,513,850 A * 5/1996 Vancura ..... 273/274
5,513,851 A * 5/1996 Harris ..... 273/274
5,632,486 A * 5/1997 Mkrtchyan ..... 273/292
5,639,092 A * 6/1997 Macaisa ..... 273/292
5,669,817 A * 9/1997 Tarantino ..... 463/13
5,775,992 A * 7/1998 Wood et al. ..... 463/13
5,823,875 A * 10/1998 Tarantino ..... 463/29
5,836,586 A * 11/1998 Marks et al. ..... 273/292
5,863,042 A * 1/1999 Lo ..... 273/292
5,897,436 A * 4/1999 Singer et al. ..... 273/292
6,019,373 A * 2/2000 Brown ..... 273/274
6,036,190 A * 3/2000 Edmunds et al. ..... 273/292
6,045,130 A * 4/2000 Jones et al. ..... 273/292
6,079,712 A * 6/2000 Eaton et al. ..... 273/274
6,102,402 A * 8/2000 Scott et al. ..... 273/292
6,113,102 A * 9/2000 Marks et al. ..... 273/292
6,123,335 A * 9/2000 Adkins ..... 273/292
6,182,968 B1 * 2/2001 Wilkinson ..... 273/292
6,234,895 B1 * 5/2001 Jones et al. ..... 463/13
6,270,404 B2 * 8/2001 Sines et al. ..... 463/12
6,273,424 B1 * 8/2001 Breeding ..... 273/292
6,279,910 B1 * 8/2001 De Keller ..... 273/292
6,286,834 B1 * 9/2001 Caputo ..... 273/274
6,302,396 B1 * 10/2001 Eaton et al. ..... 273/274

* cited by examiner

*Primary Examiner*—Benjamin H. Layno
*Assistant Examiner*—Dolores Collins
(74) *Attorney, Agent, or Firm*—Robert Ryan Morishita; Anderson & Morishita

(57) ABSTRACT

A casino game between a dealer and a player uses a deck of cards consisting essentially of the forty cards Ace through ten for each of four suits. The cards each have a value equal to the face value of the card except Aces which may be valued at one or zero. The player makes a base wager and the dealer deals one card to the player and one card to the dealer. The player forms a final hand by standing or receiving additional cards. If the player receives a card that causes the player's hand sum to exceed ten, the player automatically loses and his base wager is collected. Alternatively, if the player forms a final hand consisting essentially of only two Aces, the player automatically wins and the player is rewarded unless, in an optional embodiment, the dealer also receives a hand of two Aces. A player may optionally increase his or her base wager if the initial card dealt is an Ace. The dealer forms a final hand by drawing additional cards or standing, optionally according to house rules. Base wagers are resolved by summing the values of the cards in the dealer's final hand and declaring the final hand having a sum closer to ten, without exceeding ten, to be the winning hand. Players having winning hands are rewarded and wagers are collected from players having losing hands. In the event of a push, the player's base wager is returned.

6 Claims, 1 Drawing Sheet

CASINO GAME

RELATED APPLICATION DATA

The present application claims the priority of U.S. Provisional Application Ser. No. 60/202,037 filed May 5, 2000 by Applicant herein.

FIELD OF THE INVENTION

The present invention relates to card games. Specifically the present invention is a wagering card game played with an abridged deck of cards in which the object of the game is to form a final hand closer to ten than a dealer's hand without exceeding ten by receiving additional cards or standing on the initial hand.

BACKGROUND OF THE INVENTION

Blackjack is a well known casino card game. The object of Blackjack is to obtain a final hand total as close to twenty-one as possible without exceeding twenty-one. For purposes of calculating a hand total, each card has a value equal to the value shown on its face except face cards, which have a designated value of ten, and Aces, which may have a value of eleven or one as the player selects.

In Blackjack, each player places a wager. A dealer deals two cards to each player and to himself. The dealer's cards are dealt with one card face up and the other face down. All players receiving a natural twenty-one or Blackjack, i.e. a total of twenty-one in the initial dealt hand, are immediately rewarded and their cards collected. Typically, Blackjacks are rewarded at a rate of 2:1 or 3:2.

Each remaining player may opt to hit, i.e. receive one or more additional cards, or stand, i.e. stand on the player's current hand, with the object being to obtain a hand total closer to twenty-one than the dealer's hand total. If the player hits and receives a card that causes his hand total to exceed twenty-one, the player busts and the player's wager is immediately collected and play is terminated as to that player.

A player may also have additional options available depending on the initial hand dealt. If the player receives a pair, i.e. two cards having the same face value, the player may double his wager and split the pair, using each card of the pair as a base for a separate hand. For example, if a player were to be dealt a pair of eights, the player may split the pair by doubling his wager and playing with two hands each having an eight and an additional dealt card.

A player may also have the option to double down. Although the availability of the double down option varies from casino to casino, doubling down allows a player to an double the player's wager in exchange for a single additional card. Frequently, the double down option is only available to players having an initial hand total of ten or eleven.

After all the players have formed a final hand or busted, the dealer reveals the dealer's hand and forms a final dealer hand by hitting or standing as the house rules dictate. House rules typically require the dealer to hit on any hand total less than sixteen. The dealer resolves wagers by rewarding, typically at even money, all players with a final hand total closer to twenty-one than the dealer's final hand total. Conversely, wagers are collected from players with a final hand total further from twenty-one than the dealer's final hand total. If the dealer busts, i.e. has a final hand total exceeding twenty-one, all players who did not bust or receive a Blackjack are rewarded, again, typically at even money. If the player and dealer push, i.e. have the same final hand total, the player's wager is returned.

Blackjack has its drawbacks, however. One known drawback is the complicated rules for increasing a player's wager. For example, Blackjack includes many complex rules regarding splitting cards or doubling down. Another drawback is that in a fast paced casino game, the player must sum the cards of his or her hand quickly to avoid interfering with the flow of play.

Thus, there is a need in the art for a new game which is simpler to play than conventional Blackjack, yet provides a similar objective of forming a final hand closer to a target value than the dealer's hand.

SUMMARY OF THE INVENTION

A method of playing a casino game between a dealer and at least one player begins by providing a deck of cards. The deck consists of at least one deck of forty cards consisting essentially of the cards Ace through ten for each of four suits.

The game begins with each player placing a base wager and the dealer dealing one card to each player and one card to the dealer. Each player, in turn, forms a final hand by opting to receive additional cards or standing on the single card initially dealt. The values of the cards in the player's final hand are summed. In summing the cards, the Ace is designated as having a value of zero or one and the other cards have the value shown on the face of the card. The player's objective in forming his final hand is to obtain a sum closer to ten than the dealer's sum without exceeding ten. If the player exceeds ten, the player automatically loses and his base wager is collected. If the player forms a final hand consisting essentially of only two Aces, the player wins and is rewarded based on the player's base wager. Optionally, a final hand of two Aces may be declared an automatic win or, in an alternate embodiment, a win unless the dealer also has two Aces in which case a push is declared. In an optional embodiment, the player may be rewarded at greater than even money for an hand of two Aces.

In an optional embodiment, if the player's first dealt card is an Ace, the player may have the option of increasing his or her base wager in exchange for a single additional card. The player is immediately rewarded based on the increased base wager if the single additional card dealt to the player is an Ace. Otherwise, the increased base wager is resolved as described below.

After each player forms a final hand, the dealer forms a final dealer hand. In forming the final dealer hand, the dealer optionally plays according to a predetermined set of house rules. For example, in an optional embodiment, the dealer receives additional cards until his total is greater than or equal to six.

Once the dealer has formed a final dealer hand, the dealer sums the values of the cards in the dealer's final hand and compares his final hand with each player's final hand. The hand having a sum closer to ten, without exceeding ten, is the winning hand. In the event that the player and dealer have identical sums, a push is declared and the wager is neither collected nor rewarded.

It is an object of the present invention to provide a game that is directed at obtaining a target value and is easy to learn and play.

DESCRIPTION

Figure 1:
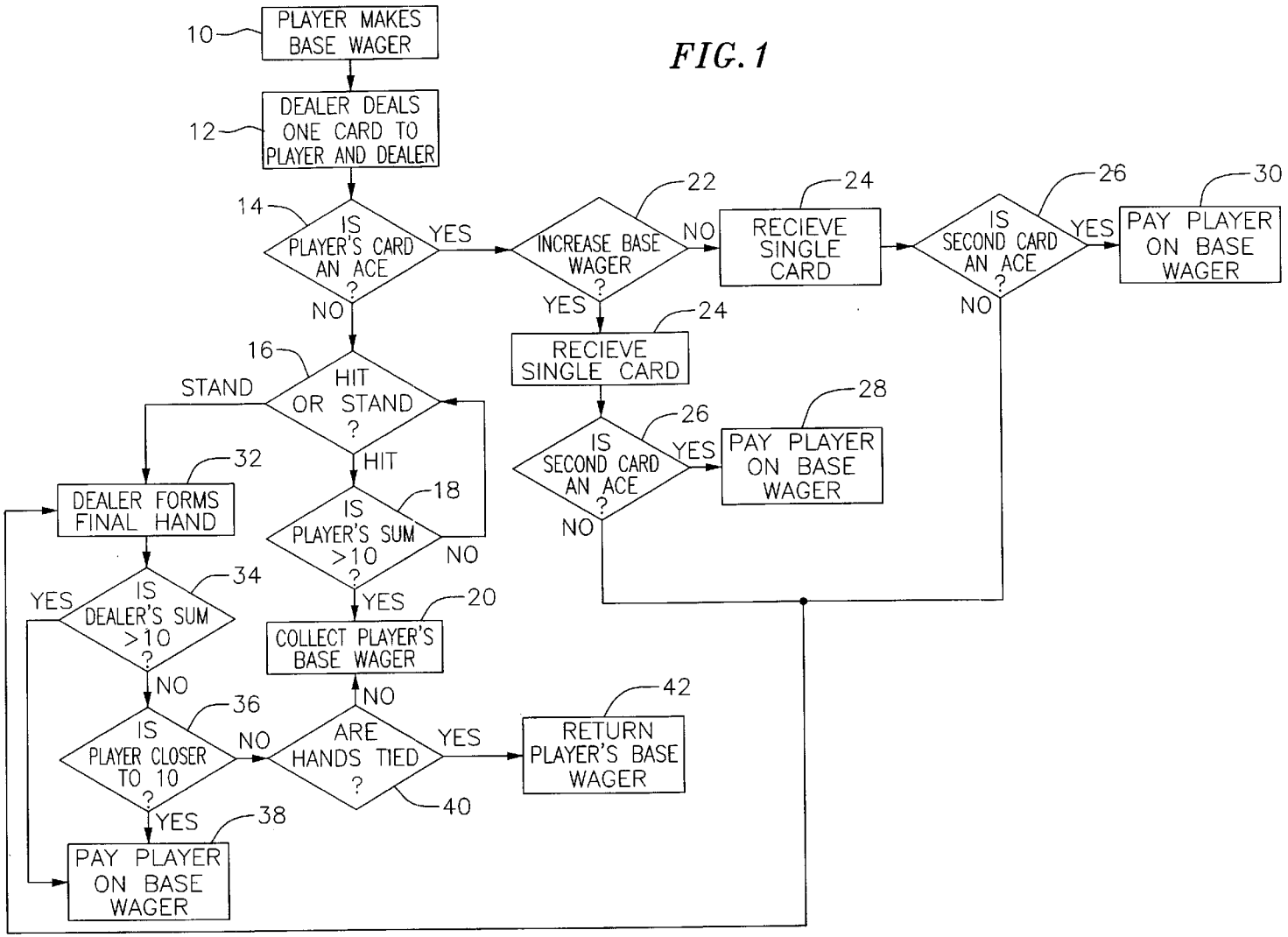
FIG. 1 is a flowchart of an embodiment of the wagering game method of the present invention.

Reference is now made to the figures wherein like parts are referred to by like numerals throughout. The game of the present invention is played using a modified standard deck of cards. Specifically, the game of the present invention is played with a deck of forty cards consisting essentially of the cards Ace through ten for each of four suits. That is, the face cards are removed from a standard deck to create the modified deck of the present invention. As will be discussed in greater detail below, Aces have a designated value of zero or one as the player selects or as mathematics dictates. For example, if designating an Ace as a one will cause the player's hand to exceed the target value of ten, the player will elect to count the Ace as a zero. All other cards have a designated value equal to the number on the face of the card.

The game of the present invention is played between a dealer and at least one player. Alternatively, the game may be played by a player against a gaming machine or a conventional general purpose computer running software embodying the method of the present invention.

Referring to FIG. 1, the game begins with a player making a base wager 10. The dealer deals a single card to the player and a single card to the dealer 12. The cards may be dealt face up or face down; however, in an optional embodiment, the card dealt to the player is face up and the card dealt to the dealer is face down.

The player forms a final hand by opting 16 to receive additional cards or stand on his initial holding. The object of the game is to form a final hand as closer to ten than the dealer's hand without exceeding ten. Also available to the player is an automatic winning hand consisting essentially of only two Aces. In an optional embodiment, the hand consisting essentially of only two Aces may be declared a push if, after forming the dealer's final hand, the dealer also receives a hand consisting essentially of only two Aces.

If the player receives additional cards 16 and any single card causes the sum of the cards in the player's hand to exceed ten 18, the player automatically loses and the player's base wager is collected 20. Alternatively, if the player receives 24 a hand consisting essentially of two Aces 26, the player automatically wins and the player is rewarded 30. Optionally, a hand of two Aces 26 may be rewarded in all circumstances except when the dealer also has a hand of two Aces. In such an optional embodiment, a push would be declared if both the player and the dealer have a hand of two Aces 26 and the player's wager would be returned. Alternatively, a hand of two Aces 26 may be an automatic win, i.e. the player is rewarded without regard to the dealer's hand. In an optional embodiment, a player receiving all hand of two Aces is rewarded at greater than even money, such as by paying the player at 2:1 or 3:2.

An optional embodiment includes an option to increase the base wager 22 if the player's initial card is an Ace 14. If the base wager is increased 22, the player receives 24 a single additional card. If the player receives an Ace 26 on the single additional card dealt to the player, the player is rewarded 28 based on the increased base wager for receiving an automatically winning hand. Again, the player may optionally be rewarded 28 at greater than even money, although in an optional embodiment, the player may only receive a return of his wager if the dealer also gets a hand consisting of essentially two Aces, i.e. if the dealer and player push. Conversely, if the base wager is increased 22 and the player receives 24 a card other than an Ace 26 on single additional card dealt to the player, the player's final hand comprises the initial Ace and the single additional card and the player's final hand must be compared to the dealer's final hand to determine whether the player is rewarded or if the increased base wager is collected. Hence, even if the player does not receive an additional Ace, the player is allowed to resolve his base wager 36 against the dealer.

For example, if a player receives an initial hand A♢, he or she may opt to increase 22 his or her base wager. If the single additional card dealt 24 to the player is A♤ to form a hand A♢ A♤, the player is rewarded based on the increased base wager 28 because the next card dealt to the player was an Ace, i.e. the player received a winning hand. In an optional embodiment, a push is declared and the player's wager returned if the dealer also receives a pair of Aces. Alternatively, if the single additional card dealt 24 to the player is 7♡ to form a hand A♢ 7♡, the player must stand 16 on his or her final hand of A♢ 7♡ for a final hand sum of eight. The player's final hand is then compared to the final dealer hand 32 to determine whether the player is paid on the increased base wager or whether the base wager is collected. Thus, in the example in which the player's final hand sum is eight, if the dealer has a final hand sum of nine, the increased base wager is collected. Alternatively, if the dealer's final hand sum is seven, the player is paid based on the increased base wager.

After each player forms a final hand, the dealer forms a final dealer hand 32. While it is contemplated that the dealer could make the decision to receive additional cards or standing, in an optional embodiment, the dealer forms his final hand according to a predetermined set of house rules. For example, the house rules could dictate that the dealer receive additional cards if his hand total is less than six and stand if his hand total is greater than or equal to six. If the dealer receives a card that causes 34 his hand total to exceed ten, all remaining players who have not exceeded the target value of ten or received an automatic winning hand are rewarded based on their base wagers 38.

Otherwise, the dealer resolves 36 base wagers by comparing the final dealer hand to each final player hand. In each comparison, a determination is made whether the dealer hand or the player hand is the winning hand. The winning hand is the hand with a sum closer to ten, without exceeding ten. Players with winning hands are rewarded, optionally at even money 38. Base wagers from players with losing hands are collected 20. Thus, for example, if the dealer has the hand 2♡ 6♢ and a player has a hand 5♧ 4♤, the player is declared the winner and rewarded 38 according to his base wager. Conversely, if the dealer has the hand 2♡ 6♢ and a player has a hand 3♧ 4♡, the dealer is declared the winner and the player's base wager is collected 20. In the event that the player and dealer have identical sums 40, a push is declared and the base wager is neither collected nor rewarded, i.e. the player's base wager is returned 42.

While certain embodiments of the present invention have been shown and described it is to be understood that the present invention is subject to many modifications and changes without departing from the spirit and scope of the claims presented herein.

I claim:

1. A method of playing a casino game between a dealer and at least one player, the dealer playing according to a predetermined set of house rules, comprising:

providing at least one deck of forty cards consisting essentially of the cards Ace through ten for each of four suits, the Aces designated as having a value of either one or zero and all other cards assigned the value shown on the face of card;

the player making a base wager;

the dealer dealing one card to the player and one card to the dealer;

the player forming a final hand by opting to stand on his single card or receive one or more additional cards, the player busting and automatically losing the player's base wager if the sum of the values of the cards in the player's final hand exceeds ten;

if the player's final hand is an automatically winning hand consisting essentially of two Aces, rewarding the player based on the base wager and terminating further play by the player;

the dealer forming a final hand by standing or drawing additional cards according to said house rules;

summing the values of the cards in the player's final hand;

resolving the player's base wager by summing the values of the cards in the dealer's final hand and declaring the final hand having a sum closer to ten, without exceeding ten, to be the winning hand, a push declared if the sum of the player's final hand equals the sum of the dealer's final hand; and paying the player according to the player's base wager if the player's final hand is the winning hand, collecting the player's base wager if the dealer's final hand is the winning hand, and returning the player's base wager if the player and dealer push.

2. The method of claim 1, further comprising the player increasing the base wager if the player's initial card is an Ace and receiving a single additional card.

3. The method of claim 1 wherein said house rules comprise the dealer receiving additional cards until the sum of the dealer's final hand is greater than or equal to six.

4. A method of playing a casino game between a dealer and at least one player, the dealer playing according to a predetermined set of house rules, comprising:

providing at least one deck of forty cards consisting essentially of the cards Ace through ten for each of four suits, the Aces assigned a value of either one or zero and all other cards assigned the value shown on the face of card;

the player making a base wager;

the dealer dealing one card to the player and one card to the dealer;

the player increasing the base wager if the player's initial card is an Ace and receiving a single additional card to form a final hand, otherwise the player forming a final hand by opting to stand on his single card or receive one or more additional cards, the player busting and automatically losing the player's base wager if the sum of the values of the cards in the player's final hand exceeds ten;

if the player's final hand is an automatically winning hand consisting of essentially of two Aces and the dealer does not also receive a hand consisting of essentially two Aces, rewarding the player based on the base wager and terminating further play by the player;

the dealer forming a final hand by standing or drawing additional cards according to said house rules;

summing the values of the cards in the player's final hand;

resolving the player's base wager by summing the values of the cards in the dealer's final hand and declaring the final hand having a sum closer to ten, without exceeding ten, to be the winning hand, a push declared if the sum of the player's final hand equals the sum of the dealer's final hand; and paying the player according to the player's base wager if the player's final hand is the winning hand, collecting the player's base wager if the dealer's final hand is the winning hand, and returning the player's base wager if the player and dealer push.

5. The method of claim 4 wherein said house rules comprise the dealer receiving additional cards until the sum of the dealer's final hand is greater than or equal to six.

6. A method of playing a casino game between a dealer and at least one player, comprising:

providing at least one deck of forty cards consisting essentially of the cards Ace through ten for each of four suits, the Aces assigned a value of either one or zero and all other cards assigned the value shown on the face of card;

the player making a base wager;

the dealer dealing one card to the player and one card to the dealer;

the player increasing the base wager if the player's initial card is an Ace and receiving at least one additional card, otherwise the player forming a final hand by opting to stand on his single card or receive one or more additional cards, the player busting and automatically losing the player's base wager if the sum of the values of the cards in the player's final hand exceeds ten;

if the player's final hand is an automatically winning hand consisting of essentially of two Aces and the dealer does not also receive a hand consisting of essentially two Aces, rewarding the player based on the base wager and terminating further play by the player;

the dealer forming a final hand by receiving additional cards until the sum of the cards in the dealer's final hand is greater than or equal to six;

summing the values of the cards in the player's final hand;

resolving the player's base wager by summing the values of the cards in the dealer's final hand and declaring the final hand having a sum closer to ten, without exceeding ten, to be the winning hand, a push declared if the sum of the player's final hand equals the sum of the dealer's final hand; and paying the player according to the player's base wager if the player's final hand is the winning hand, collecting the player's base wager if the dealer's final hand is the winning hand, and returning the player's base wager if the player and dealer push.

* * * * *